US007591685B2

(12) United States Patent
Zhu et al.

(10) Patent No.: US 7,591,685 B2
(45) Date of Patent: Sep. 22, 2009

(54) AUDIO JACK CONNECTOR AND CONTACT THEREOF WITH IMPROVED STRONG INTENSITY CONTACT PORTION

(75) Inventors: Zi-Qiang Zhu, Kunshan (CN); Chen-Xi Wang, Kunshan (CN); Hong-Qiang Han, Kunshan (CN); Lun-Song Hu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,330

(22) Filed: Dec. 11, 2008

(65) Prior Publication Data

US 2009/0149081 A1 Jun. 11, 2009

(30) Foreign Application Priority Data

Dec. 11, 2007 (CN) ..... 2007 2 0131358 U

(51) Int. Cl.
*H01R 24/04* (2006.01)

(52) U.S. Cl. ..... 439/668

(58) Field of Classification Search ..... 439/668, 439/669, 108, 63

See application file for complete search history.

(56) References Cited

U.S. PATENT DOCUMENTS

| | | | | |
|---|---|---|---|---|
| 6,478,629 | B1 * | 11/2002 | Li et al. | 439/668 |
| 6,923,687 | B2 | 8/2005 | Wang | |
| 7,361,062 | B2 * | 4/2008 | Long et al. | 439/668 |
| 2002/0052148 | A1 * | 5/2002 | Nagata | 439/668 |
| 2002/0052149 | A1 * | 5/2002 | Suzuki et al. | 439/668 |

FOREIGN PATENT DOCUMENTS

| | | |
|---|---|---|
| TW | M285826 | 1/2006 |

* cited by examiner

*Primary Examiner*—Jean F Duverne
(74) *Attorney, Agent, or Firm*—Wei Te Chung

(57) ABSTRACT

An audio jack connector includes an insulative housing and a conductive contact retained in the insulative housing. The insulative housing defines a plug receiving hole for receiving a mating plug and a mounting space located at one side of the plug receiving hole. The conductive contact has a stationary portion received in the mounting space, a spring arm forwardly extending from the stationary portion and a curly contact portion extending backwardly from the spring arm and protruding into the plug receiving hole. The curly contact portion includes opposite first and second ends in condition that the first end connects with the spring arm and the second end abuts against an inner surface of the spring arm.

6 Claims, 5 Drawing Sheets

AUDIO JACK CONNECTOR AND CONTACT THEREOF WITH IMPROVED STRONG INTENSITY CONTACT PORTION

BACKGROUND OF THE INVENTION

1. Field of the Invention

This invention generally relates to an audio jack connector, and more particularly to a miniature audio jack connector with low profile and having improved strong intensity contact.

2. Description of Related Art

Nowadays, electrical devices are becoming smaller and smaller, thereby providing limited space for mounting connectors therein. U.S. Pat. No. 6,923,687 B2, discloses a conventional audio jack connector comprising an insulative housing and a plurality of contacts accommodated in the insulative housing. The insulative housing defines a plug-insertion hole extending therethrough for receiving a mating plug. The contacts includes a rear contact which includes a stationary portion fixed in the insulative housing, a spring arm extending backwardly from the stationary portion and a contact portion extending from an end of the spring arm. The contact portion extends into the plug-insertion hole for abutting against the mating plug. The rear contact further includes a flat end portion integrally extending from the contact portion. As a result, a total length of the spring arm, the contact portion and the flat end portion is large, which will result in a big length of the audio jack connector. Understandably, the insulative housing must set corresponding space for movement of the flat end portion, which will enlarge the profile of the audio jack connector as well.

In order to solve the problem, Taiwan Patent No. 285856 discloses an audio jack connector includes a special contact. The contact includes a stationary portion, a spring arm extending from the stationary portion and a contact portion extending backwardly from the spring arm. However, a distal end of the contact portion is separate from the spring arm as a result that the intensity of the contact portion is weak. When the mating plug is withdraw from the audio jack connector, the distal end of the contact portion may easy be pulled outwardly to be destroyed.

Hence, it is desired to have an audio jack connector with improve contact structure to solve the above problem.

BRIEF SUMMARY OF THE INVENTION

An audio jack connector for receiving a mating plug includes an insulative housing and a plurality of contacts retained in the insulative housing. The insulative housing defines a plug receiving hole for receiving the mating plug and a mounting space located at one side of the plug receiving hole. The mounting space includes a retaining slit and a receiving chamber which communicates with the plug receiving hole. The contacts includes a conductive contact having a stationary portion received in the retaining slit and a spring arm forwardly extending from the stationary portion to be flexible in the receiving chamber. The conductive contact further comprises a curly contact portion extending backwardly from the spring arm and protruding into the plug receiving hole. The curly contact portion includes opposite first and second ends in condition that the first end connects with the spring arm and the second end abuts against an inner surface of the spring arm.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
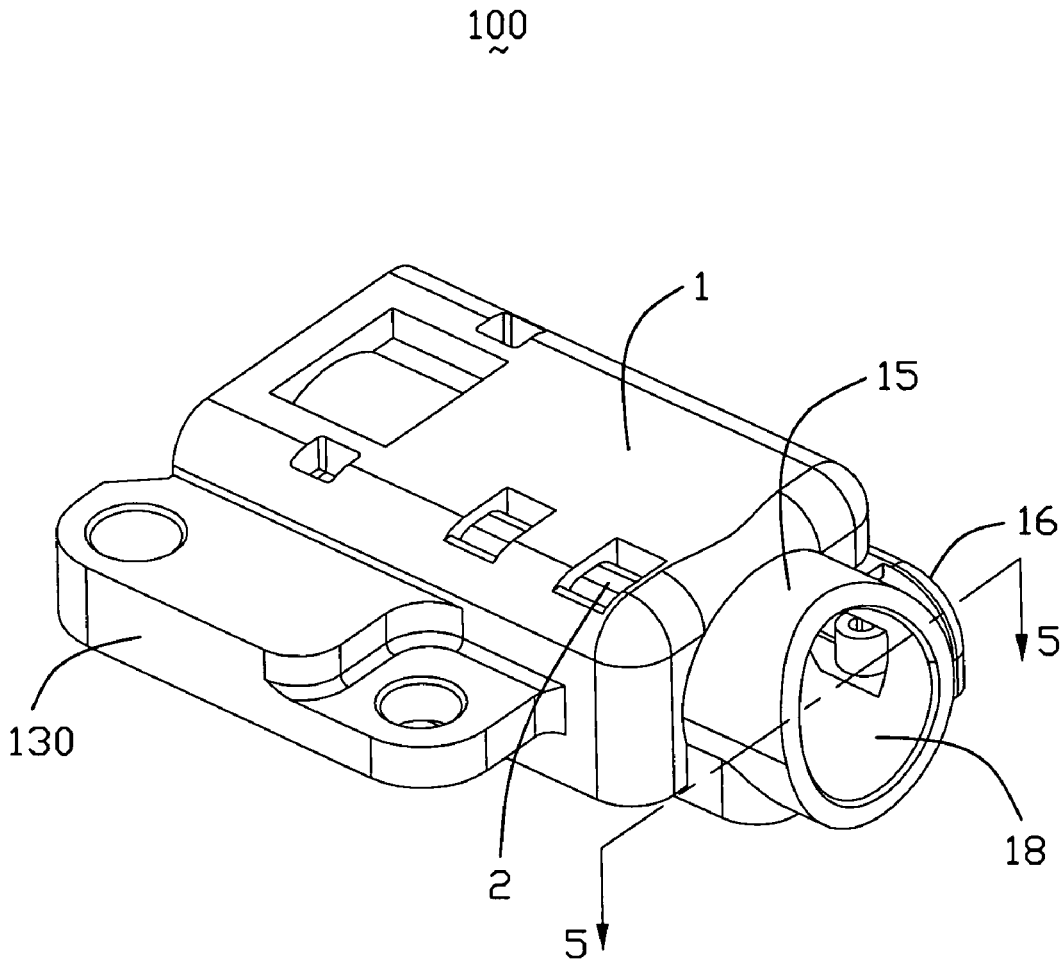
FIG. 1 is a perspective view of an audio jack connector according to a preferred embodiment of the present invention.
Figure 2:
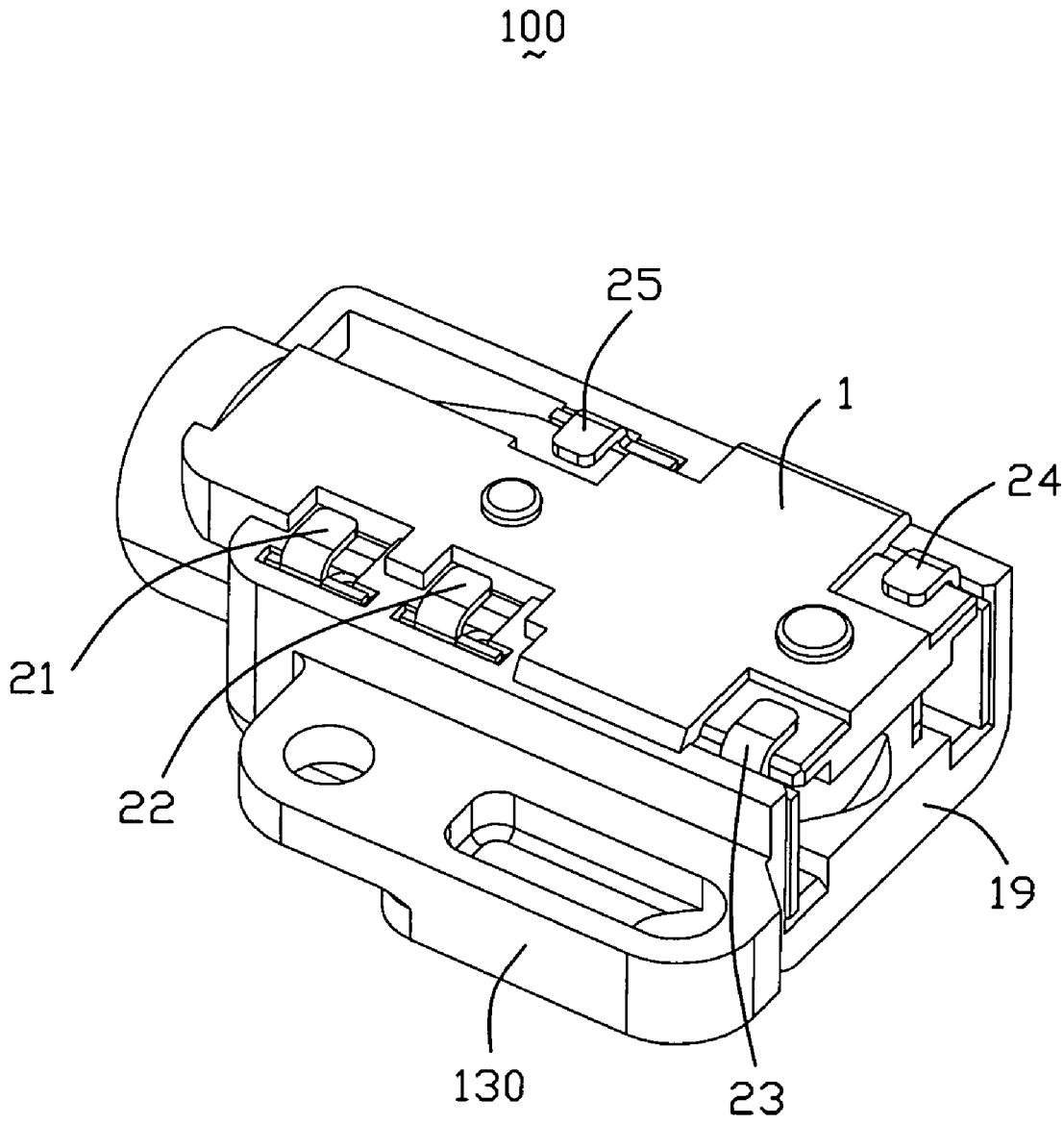
FIG. 2 is another perspective view of the audio jack connector, but viewed from another aspect.
Figure 3:
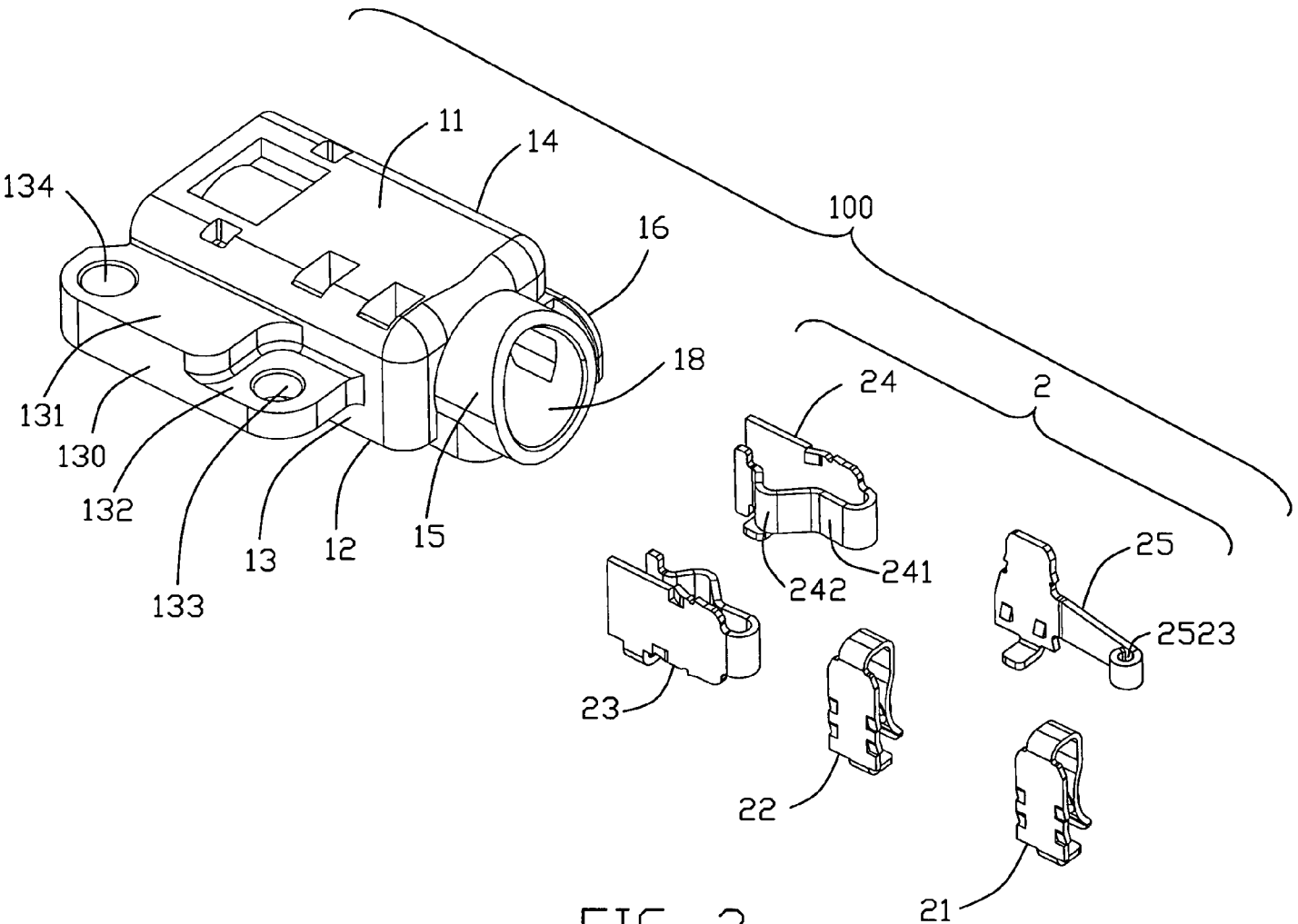
FIG. 3 is an exploded perspective view of the audio jack connector.
Figure 4:
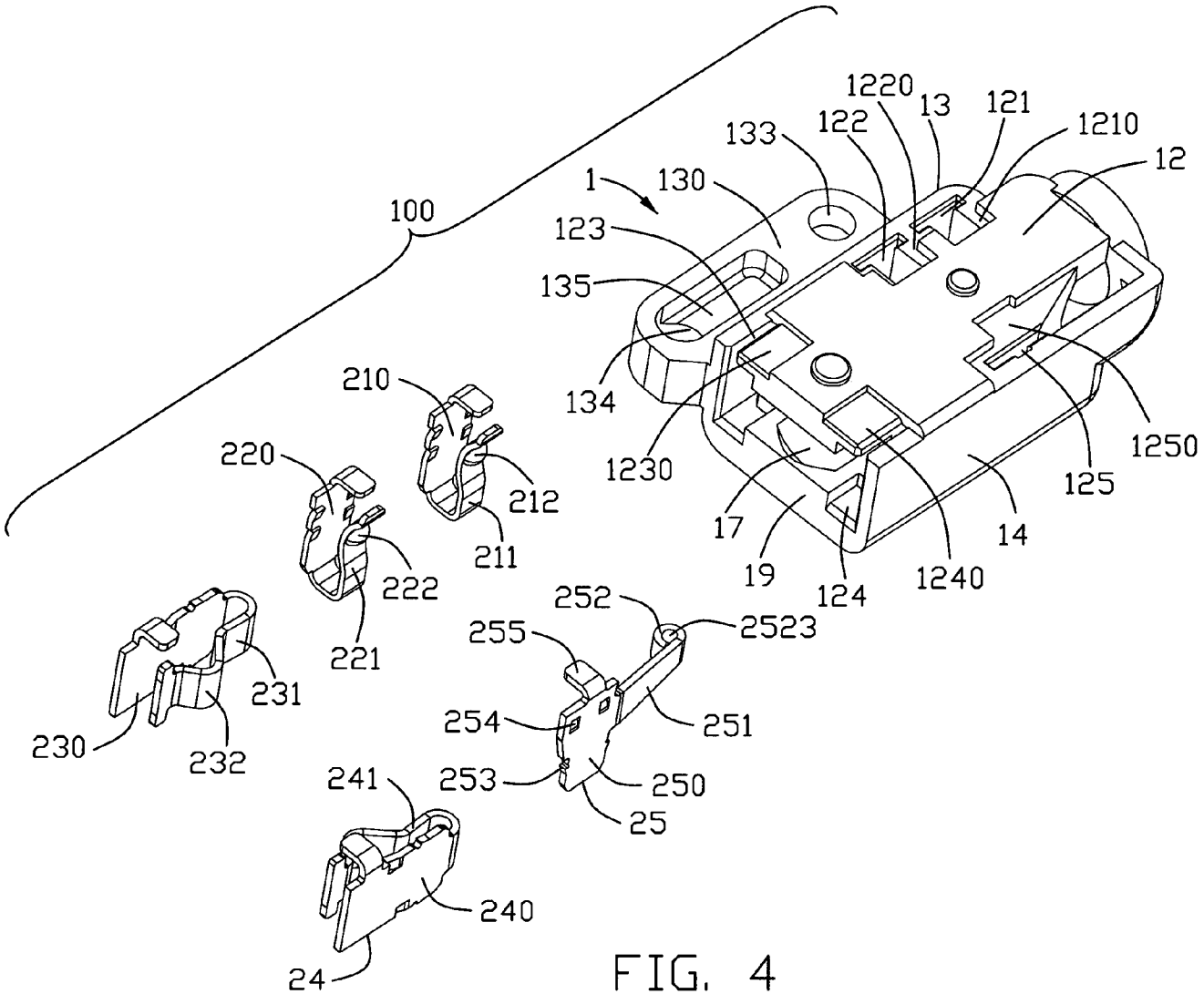
FIG. 4 is another exploded perspective view of the audio jack connector similar to FIG. 3, while taken from another aspect.

Referring to FIG. 1, a miniature audio jack connector 100 in accordance with the preferred embodiment of the present invention is disclosed. The audio jack connector 100 is adapted for being mounted on a printed circuit board (not shown) for insertion of a mating plug (not shown). The audio jack connector 100 includes an insulative housing 1 and a plurality of contacts 2 retained in the insulative housing 1.

Referring to FIGS. 1 to 5, the insulative housing 1 includes a main body 10, a cylinder portion 15 integrally extending forwardly from the main body 10 and a mounting portion 130 sidewardly extending from the main body 10. A plug receiving hole 17 is formed extending through the main body 10 and the cylinder portion 15 for receiving the mating plug. The main body 10 includes a top wall 11, a bottom wall 12 and first and second side walls 13, 14. The insulative housing 1 further includes a reinforce portion 16 forwardly extending from the main body 10 and located at a side of the cylinder portion 15. The cylinder portion 15 defines a plug hole 18 communicating with the plug receiving hole 17 for insertion of the mating plug and a slant front end 151. The bottom wall 12 defines a plurality of first, second, third, fourth, fifth retaining slits 121, 122, 123, 124, 125 and a plurality of first, second, third, fourth, fifth receiving chambers 1210, 1220, 1230, 1240, 1250 respectively communicating with the first, second, third, fourth, fifth retaining slits 121, 122, 123, 124, 125. The first and the second retaining slits 121, 122 further extend through the top wall 11 of the insulative housing 1. The third and fourth retaining slits 123, 124 further extend thorough a real wall 19 of the insulative housing 1. The fifth receiving chamber 1250 forwardly is located at one side of the plug receiving hole 17 and communicates with the plug receiving hole 17.

The mounting portion 130 is adapted for mounting the audio jack connector 100 on the PCB. The mounting portion 130 includes a first mounting section 132 and a second mounting section 131 thicker than the first mounting section 132. The first and the second mounting sections 132, 131 define first and second mounting holes 133, 134, respectively, in condition that the first and the second mounting holes 133, 134 are aligned with each other along a plug insertion direction. The second mounting section 131 defines an enlarged slot 135 extending along the plug insertion direction and communicating with the second mounting holes 134.

Referring to FIGS. 2 to 5, the contacts 2 includes a conductive contact 25 which has a stationary portion 250 received in the fifth mounting slit 125, a spring arm 251 extending forwardly from the stationary portion 250, a curly contact portion 252 extending backwardly from the spring arm 251 in order to minimize the profile of the insulative housing 1. The stationary portion 250 includes a plurality of tubers 253, 254 for stably mounting the stationary portion 250 in the fifth mounting slit 125. The contact portion 252 includes opposite first and second ends 2521, 2522 in condition that the first end 2521 connects with the spring arm 251 and the second end 2522 abuts against an inner surface of the spring arm 251. The contact portion 252 includes arc surface at one side of the spring arm 251 and exposed to the plug receiving hole 17. As a result, the contact portion 252 has strong intensity and can't be easily deformable when abutting against the mating plug. The contact portion 252 forms a essentially round hole 2523 extending along a vertical direction. The conductive contact 25 further includes a soldering portion extending from and perpendicular to the stationary portion 250 to be soldered on the PCB.

The contacts 2 include a plurality of middle contacts 21, 22 and rear contacts 23, 24. The middle contacts 21, 22 are of the same configuration and respectively include retaining portions 210, 220 received in the first and second retaining slits 121, 122, elastic portions 211, 221 deformable received in the first and second receiving chambers 1210, 1220, and contact sections 212, 222 protruding into plug receiving hole 17 for abutting against the mating plug.

The rear contacts 23, 24 are symmetrically located at opposite sides of the plug receiving hole 17 and includes retaining portions 230, 240 received in the third and fourth retaining slits 123, 124, elastic portions 231, 241 deformable received in the third and fourth receiving chambers 1230, 1240, and contact sections 232, 242 protruding into plug receiving hole 17 for abutting against the mating plug.

Figure 5:
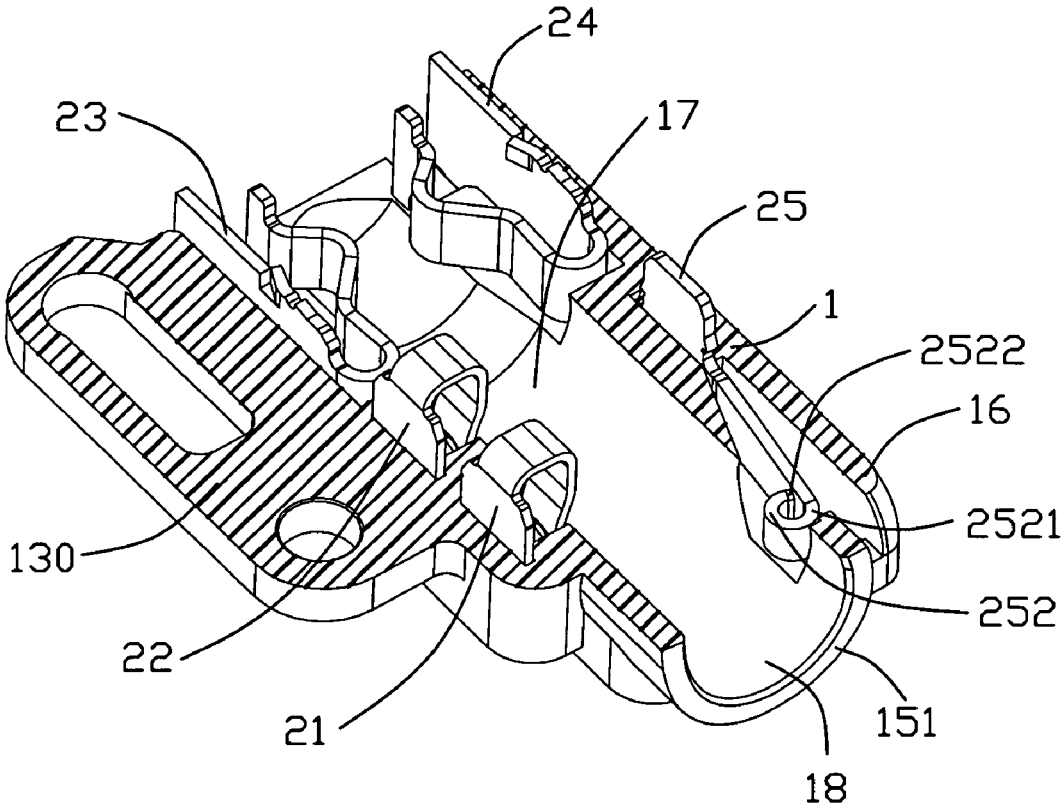
FIG. 5 is a part cross-sectional perspective view of the audio jack connector taken along line 5-5 of FIG. 1 showing contact arrangement thereof.

Referring to FIG. 5, in assembly, the spring arm 251 is accommodated in the fifth receiving chamber 1250 and is deformable in the fifth receiving chamber 1250 when the mating plug is inserted into the plug receiving hole 17. The contact portion 252 protrudes into the plug receiving hole 17 for abutting against the mating plug. The contact portion 252 is nearest to the front end 151 of the cylinder portion 15 than that of the contact sections 212, 222, 232, 242 of middle and the rear contacts 21, 22, 23, 24. When the mating plug is removal from the plug receiving hole 17, the mating plug abuts against the contact portion 252 in order to apart from the contact portion 252. Since the contact portion 252 has enough intensity, it can endure such engagement without big deformation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An audio jack connector for receiving a mating plug, comprising:

an insulative housing defining a plug receiving hole for receiving the mating plug and a mounting space located at one side of the plug receiving hole, the mounting space including a retaining slit and a receiving chamber which communicates with the plug receiving hole; and a conductive contact having a stationary portion received in the retaining slit and a spring arm forwardly extending from the stationary portion to be flexible in the receiving chamber; wherein the conductive contact further comprises a curly contact portion extending backwardly from the spring arm and protruding into the plug receiving hole, the curly contact portion comprising opposite first and second ends in condition that the first end connects with the spring arm and the second end abuts against an inner surface of the spring arm.

2. The audio jack connector according to claim 1, wherein the curly contact portion comprises an arc surface exposed to the plug receiving hole for abutting against the mating plug.

3. The audio jack connector according to claim 1, wherein the curly contact portion forms an essentially round hole extending along a vertical direction.

4. The audio jack connector according to claim 1, further comprising a plurality of additional contacts with contact sections extending into the plug receiving hole for abutting against the mating plug.

5. The audio jack connector according to claim 4, wherein the curly contact portion is nearest to a front end of the cylinder portion than that of the contact sections of the additional contacts.

6. The audio jack connector according to claim 4, wherein the additional contacts comprise a pair of first and second rear contacts symmetrically located at opposite sides of the plug receiving hole.

* * * * *